US006865277B2

(12) United States Patent
Bank et al.

(10) Patent No.: US 6,865,277 B2
(45) Date of Patent: Mar. 8, 2005

(54) PASSENGER VEHICLE

(75) Inventors: Graham Bank, Woodbridge (GB); Martin Colloms, London (GB); Neil Simon Owen, Huntingdon (GB); Neil Harris, Cambridge (GB); Martin Christopher Cassey, Cambridge (GB)

(73) Assignee: New Transducers Limited, Cambridgeshire (GB)

( * ) Notice: Subject to any disclaimer, the term of this patent is extended or adjusted under 35 U.S.C. 154(b) by 46 days.

(21) Appl. No.: 10/199,509

(22) Filed: Jul. 22, 2002

(65) Prior Publication Data

US 2003/0053642 A1 Mar. 20, 2003

Related U.S. Application Data

(63) Continuation-in-part of application No. 09/768,002, filed on Jan. 24, 2001.

(60) Provisional application No. 60/306,861, filed on Jul. 23, 2001, provisional application No. 60/178,315, filed on Jan. 27, 2000, provisional application No. 60/205,465, filed on May 19, 2000, and provisional application No. 60/218,062, filed on Jul. 13, 2000.

(30) Foreign Application Priority Data

Jul. 20, 2001 (GB) ..... 0117665

(51) Int. Cl.[7] ..... H04R 25/00

(52) U.S. Cl. ..... 381/152; 381/381; 381/389

(58) Field of Search ..... 381/152, 186, 381/190, 322, 324, 337, 386, 396, 398, 421, 423; 181/150, 157, 161, 173

(56) References Cited

U.S. PATENT DOCUMENTS

| | | | |
|---|---|---|---|
| 4,078,160 | A | 3/1978 | Bost |
| 4,401,857 | A | 8/1983 | Morikawa |

(List continued on next page.)

FOREIGN PATENT DOCUMENTS

| | | | |
|---|---|---|---|
| EP | 0 711 096 | A1 | 5/1996 |
| EP | 0 881 856 | A1 | 12/1998 |
| EP | 0 993 231 | A2 | 4/2000 |
| GB | 2 166 022 | A | 4/1986 |
| WO | WO 83/02384 | A1 | 7/1983 |
| WO | WO 96/31333 | A1 | 10/1996 |
| WO | WO 97/09842 | A2 | 3/1997 |
| WO | WO 97/09844 | A1 | 3/1997 |
| WO | WO 97/09846 | A1 | 3/1997 |
| WO | WO 98/42536 | A1 | 10/1998 |
| WO | WO 98/52383 | A1 | 11/1998 |
| WO | WO 98/58416 | A1 | 12/1998 |
| WO | WO 98/58521 | A1 | 12/1998 |
| WO | WO 99/08479 | A1 | 2/1999 |
| WO | WO 99/11490 | A1 | 3/1999 |
| WO | WO 99/41939 | A1 | 8/1999 |
| WO | WO 00/13464 | A1 | 3/2000 |
| WO | WO 00/33612 | A2 | 6/2000 |
| WO | WO 00/45616 | A1 | 8/2000 |
| WO | WO 00/48425 | A2 | 8/2000 |
| WO | WO 01/54450 | A2 | 7/2001 |

OTHER PUBLICATIONS

Jonathan A. Bost et al., "A New Piezoelectric Driver Enhances Horn Performance," An Audio Engineering Society Preprint, Preprint No. 1374 (D–6), presented at the 60$^{th}$ Convention, May 2–5, 1978, pp. 1–14.

*Primary Examiner*—Curtis Kuntz
*Assistant Examiner*—Brian Ensey
(74) *Attorney, Agent, or Firm*—Foley & Lardner LLP

(57) ABSTRACT

A vehicle component for mounting in a passenger compartment of a vehicle, the component comprising a loudspeaker having an acoustic radiator capable of supporting bending wave vibration and an electromechanical force transducer mounted to the acoustic radiator to excite bending waves in the acoustic radiator to produce an acoustic output, characterized in that the transducer has an intended operative frequency range and comprises a resonant element having a frequency distribution of modes in the operative frequency range and a coupler on the resonant element for mounting the transducer to the acoustic radiator.

19 Claims, 6 Drawing Sheets

U.S. PATENT DOCUMENTS 4,414,436 A 11/1983 Sashida et al.
4,481,663 A 11/1984 Spranger
4,593,160 A 6/1986 Nakamura
5,632,841 A 5/1997 Hellbaum et al.
5,802,195 A 9/1998 Regan et al.
6,031,926 A 2/2000 Azima et al.
6,195,440 B1 2/2001 Warnaka et al.
6,215,884 B1 4/2001 Parrella et al.
6,332,029 B1 12/2001 Azima et al.
6,377,695 B1 4/2002 Azima et al.
6,480,614 B1 * 11/2002 Denda et al. ..... 381/423
6,519,346 B1 2/2003 Asada et al.
6,554,098 B1 * 4/2003 Komura ..... 181/173
6,621,908 B2 * 9/2003 Asada et al. ..... 381/152
2001/0033669 A1 10/2001 Bank et al.

* cited by examiner

PASSENGER VEHICLE

This application claims the benefit of U.S. Provisional Application Ser. No. 60/306,861 filed Jul. 23, 2001 (incorporated by reference in its entirety) and is a continuation-in-part application of U.S. application Ser. No. 09/768,002 filed Jan. 24, 2001, which claims the benefit of U.S. Provisional Application Ser. Nos. 60/178,315, filed Jan. 27, 2000; 60/205,465, filed May 19, 2000 and 60/218,062, filed Jul. 13, 2000.

TECHNICAL FIELD

The invention relates to passenger vehicles and more particularly to passenger vehicles incorporating loudspeakers comprising panel-form acoustic radiating elements. The passenger vehicles may be marine vehicles, ground based vehicles, e.g. automobiles or aerospace vehicles.

BACKGROUND ART

Embodiments of the present invention use bending wave loudspeakers, particularly resonant bending wave speakers of the kind known as distributed mode acoustic radiators, as taught in International application WO97/09842 and corresponding U.S. Pat. No. 6,332,029 the latter of which is herein incorporated by reference. It is known from WO 97/09842 and corresponding U.S. Pat. No. 6,332,029 and other publications (e.g. WO97/09846, WO99/08479 and WO00/33612 which correspond to granted U.S. Pat. No. 6,031,926, and pending U.S. application Ser. Nos. 09/497,655 and 09/450,754 in the name New Transducers Limited) to apply one or more exciters to a bending wave panel for energizing bending waves in the panel. The locations of the exciters may be chosen with consideration for modal drive coupling, moderating directional effects or adjusting behaviour through the coincidence frequency region.

This invention is particularly concerned with acoustic devices in the form of resonant acoustic radiator loudspeakers for use in passenger vehicles such as automobiles, aircraft, boats, railway trains, etc., and to vehicles incorporating such loudspeakers. There are various International applications of the present applicant which discuss the application of such bending wave speakers in passenger vehicles, for example WO 97/09844, WO 98/42536, WO 99/11490, WO 00/45616 and WO 00/48425. The corresponding U.S. application Ser. Nos. 09/029,349, 09/398,057, 09/501,770 (now U.S. Pat. No. 6,377,695), Ser. Nos. 09/494,304 and 09/928,924 are herein incorporated by reference.

SUMMARY OF THE INVENTION

According to the invention, there is provided a vehicle having a passenger compartment characterised by a loudspeaker in the passenger compartment, the loudspeaker comprising an acoustic radiator capable of supporting bending wave vibration and an electromechanical force transducer mounted to the acoustic radiator to excite bending waves in the acoustic radiator to produce an acoustic output, characterised in that the transducer has an intended operative frequency range and comprises a resonant element having a frequency distribution of modes in the operative frequency range and coupling means for mounting the transducer to the acoustic radiator.

The acoustic radiator may be part or whole of an internal component of the passenger vehicle. The internal component may be moulded with grooves which define a generally rectangular relatively thin area within the component. The area may be stiffened with a lightweight cellular core to form a panel-form acoustic radiator.

The internal component may be selected from internal trim, e.g. roof lining or door trim, interior door pillars, interior vehicle centre console, e.g. dashboard, parcel shelf, sun visor, rear view mirror, headrest and seat backs. For an internal component in the form of a sun visor, the loudspeaker may comprise two acoustic radiators and the transducer may be sandwiched between the two radiators and mounted to simultaneously drive both radiators.

The resonant element of the transducer may be active e.g. may be a piezoelectric transducer and may be in the form of a strip of piezoelectric material. Alternatively, the resonant element may be passive and the transducer may further comprise an active transducer, e.g. an inertial or grounded vibration transducer, actuator or exciter, e.g. moving coil transducer. The active transducer may be a bender or torsional transducer (e.g. of the type taught in WO00/13464 and corresponding U.S. application Ser. No. 09/384,419). Furthermore, the transducer may comprise a combination of passive and active elements to form a hybrid transducer.

A number of transducer, exciter, or actuator mechanisms have been developed to apply a force to a structure, e.g. an acoustic radiator of a loudspeaker. There are various types of these transducer mechanisms, for example moving coil, moving magnet, piezoelectric or magnetostrictive types. Typically, electrodynamic speakers using coil and magnet type transducers lose 99% of their input energy to heat whereas a piezoelectric transducer may lose as little as 1%. Thus, piezoelectric transducers are popular because of their high efficiency.

There are several problems with piezoelectric transducers, for example, they are inherently very stiff, for example comparable to brass foil, and are thus difficult to match to an acoustic radiator, especially to the air. Raising the stiffness of the transducer moves the fundamental resonant mode to a higher frequency. Thus such piezoelectric transducers may be considered to have two operating ranges. The first operating range is below the fundamental resonance of the transducer. This is the "stiffness controlled" range where velocity rises with frequency and the output response usually needs equalisation. This leads to a loss in available efficiency. The second range is the resonance range beyond the stiffness range, which is generally avoided because the resonances are rather fierce.

Moreover, the general teaching is to suppress resonances in a transducer, and thus piezoelectric transducers are generally used only in the frequency range below or at the fundamental resonance of the transducers. Where piezoelectric transducers are used above the fundamental resonance frequency, it is necessary to apply damping to suppress resonance peaks.

The problems associated with piezoelectric transducers similarly apply to transducers comprising other "smart" materials, i.e. magnetostrictive, electrostrictive, and electret type materials. Various piezoelectric transducers are also known, for example as described in EP 0993 231A of Shinsei Corporation, EP 0881 856A of Shinsei Corporation, U.S. Pat. No. 4,593,160 of Murata Manufacturing Co. Limited, U.S. Pat. No. 4,401,857 of Sanyo Electric Co Limited, U.S. Pat. No. 4,481,663 of Altec Corporation and UK patent application GB2,166,022A of Sawafuji. However, it is an object of the present invention to employ an improved transducer.

The transducer used in the present invention may be considered to be an intendedly modal transducer. The coupling means may be attached to the resonant element, for example, at a position which is beneficial for coupling modal activity of the resonant element to the acoustic radiator. The parameters, e.g. aspect ratio, bending stiffness, thickness, and geometry, of the resonant element may be selected to enhance the distribution of modes in the resonant element in the operative frequency range. The bending stiffness and thickness of the resonant element may be selected to be isotropic or anisotropic. The variation of bending stiffness and/or thickness may be selected to enhance the distribution of modes in the resonant element. Analysis, e.g. computer simulation using FEA or modelling, may be used to select the parameters.

The distribution may be enhanced by ensuring a first mode of the active element is near to the lowest operating frequency of interest. The distribution may also be enhanced by ensuring a satisfactory, e.g. high, density of modes in the operative frequency range. The density of modes is preferably sufficient for the active element to provide an effective mean average force which is substantially constant with frequency. Good energy transfer may provide beneficial smoothing of modal resonances. Alternatively, or additionally, the distribution of modes may be enhanced by distributing the resonant bending wave modes substantially evenly in frequency, i.e. to smooth peaks in the frequency response caused by "bunching" or clustering of the modes. Such a transducer may thus be known as a distributed mode transducer or DMT.

Such an intendedly modal or distributed mode transducer is described in International patent application WO 01/54450 and U.S. patent application Ser. No. 09/768,002 filed Jan. 24, 2001 (the latter of which is herein incorporated by reference in its entirety).

The transducer may comprise a plurality of resonant elements each having a distribution of modes, the modes of the resonant elements being arranged to interleave in the operative frequency range and thus enhance the distribution of modes in the transducer as a whole device. The resonant elements may have different fundamental frequencies and thus, the parameters, e.g. loading, geometry, or bending stiffness of the resonant elements may be different.

The resonant elements may be coupled together by connecting means in any convenient way, e.g. on generally stiff stubs, between the elements. The resonant elements are preferably coupled at coupling points which enhance the modality of the transducer and/or enhance the coupling at the site to which the force is to be applied. Parameters of the connecting means may be selected to enhance the modal distribution in the resonant element. The resonant elements may be arranged in a stack. The coupling points may be axially aligned.

The resonant element may be plate-like or may be curved out of planar. A plate-like resonant element may be formed with slots or discontinuities to form a multi-resonant system. The resonant element may be in the shape of a beam, trapezoidal, hyperelliptical or may be generally disc shaped. Alternatively, the resonant element may be rectangular and may be curved out of the plane of the rectangle about an axis along the short axis of symmetry.

The resonant element may be modal along two substantially normal axes, each axis having an associated fundamental frequency. The ratio of the two fundamental frequencies may be adjusted for best modal distribution, e.g. about 9:7 (~1.286:1).

As examples, the arrangement of such modal transducer may be any of: a flat piezoelectric disc; a combination of at least two or preferably at least three flat piezoelectric discs; two coincident piezoelectric beams; a combination of multiple coincident piezoelectric beams; a curved piezoelectric plate; a combination of multiple curved piezoelectric plates or two coincident curved piezoelectric beams.

The interleaving of the distribution of the modes in each resonant element may be enhanced by optimising the frequency ratio of the resonant elements, namely the ratio of the frequencies of each fundamental resonance of each resonant element. Thus, the parameter of each resonant element relative to one another may be altered to enhance the overall modal distribution of the transducer.

When using two active resonant elements in the form of beams, the two beams may have a frequency ratio (i.e. ratio of fundamental frequency) of 1.27:1. For a transducer comprising three beams, the frequency ratio may be about 1.315:1.147:1. For a transducer comprising two discs, the frequency ratio may be about 1.1+/−0.02 to 1 to optimise high order modal density or may be about 3.2 to 1 to optimise low order modal density. For a transducer comprising three discs, the frequency ratio may be about 3.03:1.63:1 or may be about 8.19:3.20:1.

The parameters of the coupling means may be selected to enhance the distribution of modes in the resonant element in the operative frequency range. The coupling means may be vestigial, e.g. a controlled layer of adhesive.

The coupling means may be positioned asymmetrically with respect to the panel so that the transducer is coupled asymmetrically. The asymmetry may be achieved in several ways, for example by adjusting the position or orientation of the transducer with respect to axes of symmetry in the panel or the transducer.

The coupling means may form a line of attachment. Alternatively, the coupling means may form a point or small local area of attachment where the area of attachment is small in relation to the size of the resonant element. The coupling means may be in the form of a stub and have a small diameter, e.g. about 3 to 4 mm. The coupling means may be low mass.

The coupling means may comprise more than one coupling point and may comprise a combination of points and/or lines of attachment. For example, two points or small local areas of attachment may be used, one positioned near the centre and one positioned at the edge of the active element. This may be useful for plate-like transducers which are generally stiff and have high natural resonance frequencies.

Alternatively only a single coupling point may be provided. This may provide the benefit, in the case of a multi-resonant element array, that the output of all the resonant elements is summed through the single coupling means so that it is not necessary for the output to be summed by the load. The coupling means may be chosen to be located at an anti-node on the resonant element and may be chosen to deliver a constant average force with frequency. The coupling means may be positioned away from the centre of the resonant element.

The position and/or the orientation of the line of attachment may be chosen to optimise the modal density of the resonant element. The line of attachment is preferably not coincident with a line of symmetry of the resonant element. For example, for a rectangular resonant element, the line of attachment may be offset from the short axis of symmetry (or centre line) of the resonant element. The line of attachment may have an orientation which is not parallel to a symmetry axis of the panel.

The shape of the resonant element may be selected to provide an off-centre line of attachment which is generally at the centre of mass of the resonant element. One advantage of this embodiment is that the transducer is attached at its centre of mass and thus there is no inertial imbalance. This may be achieved by an asymmetric shaped resonant element which may be in the shape of a trapezium or trapezoid.

For a transducer comprising a beam-like or generally rectangular resonant element, the line of attachment may extend across the width of the resonant element. The area of the resonant element may be small relative to that of the acoustic radiator.

The acoustic radiator may be in the form of a panel. The panel may be flat and may be lightweight. The material of the acoustic radiator may be anisotropic or isotropic.

The acoustic radiator may be a resonant bending wave device having a distribution of resonant bending wave modes. The properties of the acoustic radiator may be chosen to distribute the resonant bending wave modes substantially evenly in frequency, i.e. to smooth peaks in the frequency response caused by "bunching" or clustering of the modes. In particular, the properties of the acoustic radiator may be chosen to distribute the lower frequency resonant bending wave modes substantially evenly in frequency. The lower frequency resonant bending wave modes are preferably the ten to twenty lowest frequency resonant bending wave modes of the acoustic radiator.

The transducer location may be chosen to couple substantially evenly to the resonant bending wave modes in the acoustic radiator, in particular to lower frequency resonant bending wave modes. In other words, the transducer may be mounted at a location where the number of vibrationally active resonance anti-nodes in the acoustic radiator is relatively high and conversely the number of resonance nodes is relatively low. Any such location may be used, but the most convenient locations are the near-central locations between about 38% to about 62% along each of the length and width axes of the acoustic radiator, but off-centre. Specific or preferential locations are at about 3/7, 4/9 or 5/13 of the distance along the axes; a different ratio for the length axis and the width axis is preferred. Preferred is about 4/9 length, about 3/7 width of an isotropic panel having an aspect ratio of about 1:1.13 or about 1:1.41.

The operative frequency range may be over a relatively broad frequency range and may be in the audio range and/or ultrasonic range. There may also be applications for sonar and sound ranging and imaging where a wider bandwidth and/or higher possible power will be useful by virtue of distributed mode transducer operation. Thus, operation over a range greater than the range defined by a single dominant, natural resonance of the transducer may be achieved.

The lowest frequency in the operative frequency range is preferably above a predetermined lower limit which is about the fundamental resonance of the transducer.

For example, for a beam-like active resonant element, the force may be taken from the centre of the beam, and may be matched to the mode shape in the acoustic radiator to which it is attached. In this way, the action and reaction may co-operate to give a constant output with frequency. By connecting the resonant element to the acoustic radiator at an anti-node of the resonant element, the first resonance of the resonant element may appear to be a low impedance. In this way, the acoustic radiator should not amplify the resonance of the resonant element.

BRIEF DESCRIPTION OF DRAWINGS

Examples that embody the best mode for carrying out the invention are described in detail below and are diagrammatically illustrated in the accompanying drawings in which.

DETAILED DESCRIPTION

Figure 1A:
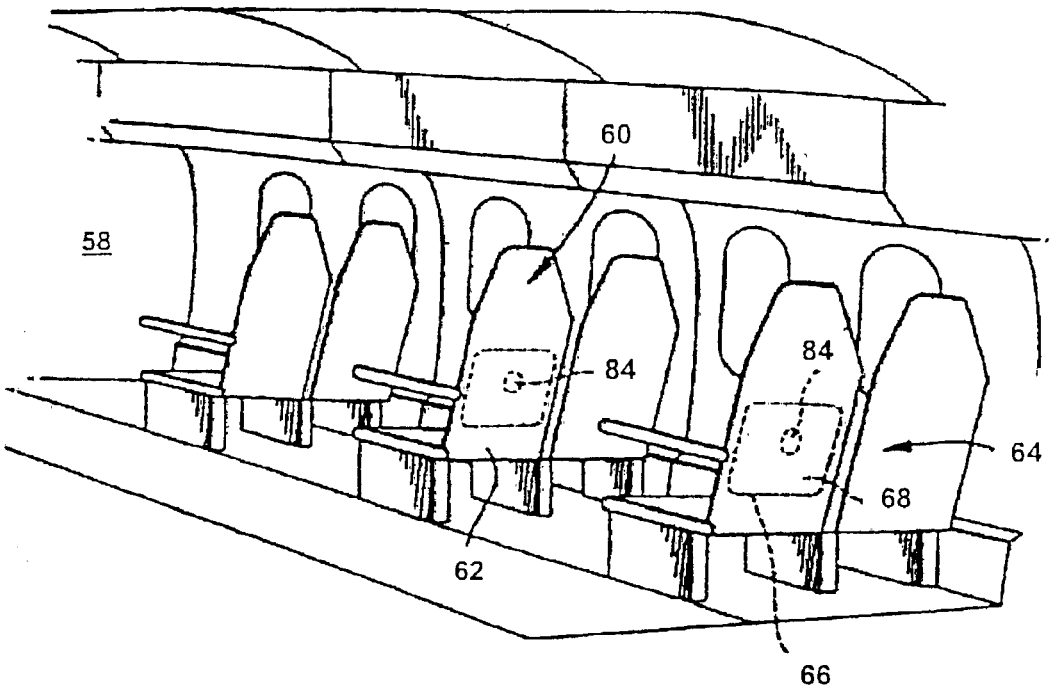
FIG. 1*a* shows an interior section of a cabin employing loudspeakers embodying the present invention.

FIG. 1*a* shows a cabin (58) of a passenger vehicle, e.g. an aircraft, railway carriage, motor coach or ferry, which has rows of passenger seats (60) each having conventional seat backs (62) which are shells moulded from a suitable plastics material. The seat backs (62) are moulded with grooves (66) which define a generally rectangular, relatively thin panel (68) in the seat back.

The panel is designed to be capable of supporting bending waves, particularly resonant bending wave modes as taught in WO97/09842 and WO97/09844 (U.S. Pat. No. 6,332,029 and U.S. patent application Ser. No. 09/029,349) of the present applicant. A transducer (84) is mounted to the panels to launch or to excite bending wave vibration to form a loudspeaker (64) which is capable of producing an acoustic output. A loudspeaker (64) may be incorporated into some or all of the seat backs (62). The transducer (84) is an intendedly modal transducer or distributed mode transducer as hereinbefore described and as described in WO 01/54450 and U.S. patent application Ser. No. 09/768,002.

Figure 1B:
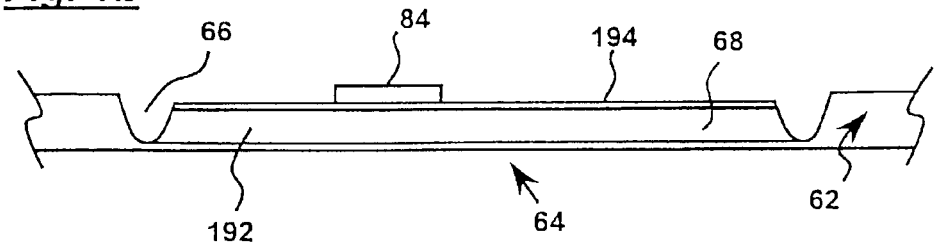
FIG. 1*b* shows a cross-section through a section of a seat in the cabin of FIG. 1*a;*

As shown more clearly in FIG. 1*b*, each panel (68) is stiffened on their inner faces with a lightweight cellular core (192) which is backed by an inner skin (194) to form a rigid lightweight panel which is capable of supporting bending waves. The grooves (66) act as a resilient suspension for each panel and the surrounding seat backs (62) form a frame for each panel.

Figure 2:
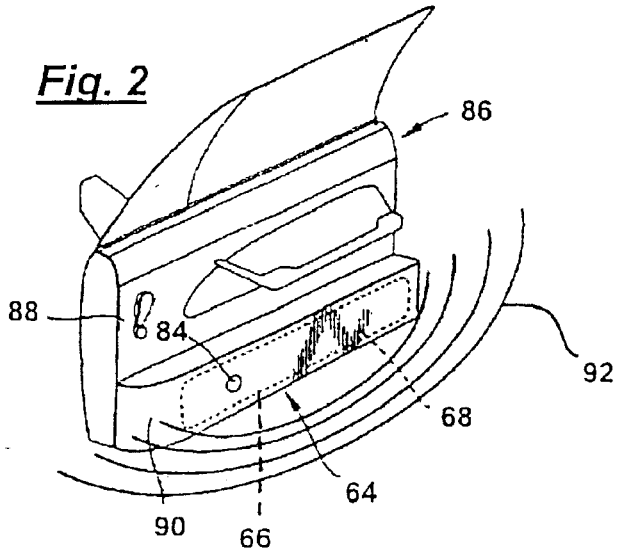
FIG. 2 shows a perspective view of an automobile door employing a loudspeaker embodying the present invention.

FIG. 2 shows an automobile door (86) comprising a door trim panel (88) having a pocket (90) incorporating a loudspeaker (64) similar to that described in FIGS. 1*a* and 1*b*. The door trim panel (88) is moulded or pressed from plastics or fibreboard. The lining is formed with grooves (66) which define and act as a resilient suspension for a panel (68). The surrounding lining forms a frame for the panel. A transducer (84) is mounted to the panel to launch or to excite bending wave vibration to produce sound (92) which radiates from the loudspeaker (64) as shown.

Figure 3:
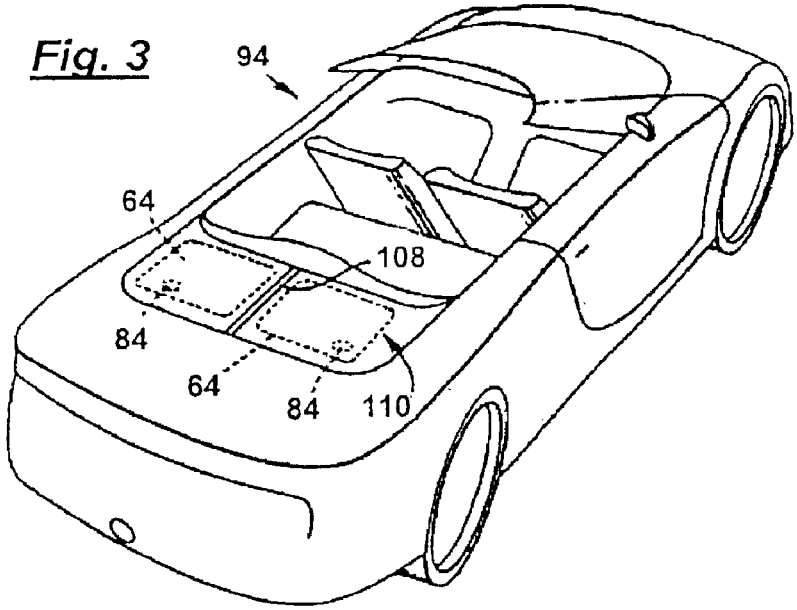
FIG. 3 shows a perspective view of an automobile employing a loudspeaker embodying the present invention.

FIG. 3 shows an automobile (94) with loudspeakers (64) similar to those of FIGS. 1*a* and 1*b* mounted in a parcel shelf (110) which is located towards the rear of the automobile (94). The parcel shelf (110) is divided longitudinally, by means of a structural rib (108), into two areas to produce a stereo pair of loudspeakers (64). As in the previous examples, the loudspeakers (64) comprise a panel which is capable of supporting bending waves and an intendedly modal transducer (84) mounted to the panels to launch or to excite bending wave vibration to form a loudspeaker (64) which is capable of producing an acoustic output.

Figure 4A:
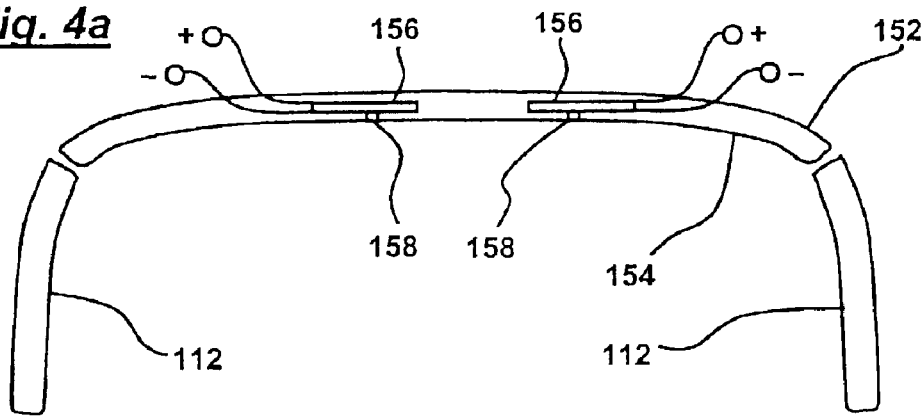
FIG. 4*a* is a cross-sectional view of an automobile roof member employing a loudspeaker embodying the present invention.

FIG. 4*a* shows a cross-sectional view of an upper portion of a vehicle, the upper portion comprising side pillars (112) which support a roof section (152) which is covered by an interior trim roof lining (154). The roof lining (154) may be designed to have regions which extend over part or whole of the lining (154) and which are capable of supporting bending waves, particularly resonant bending wave modes. Two intendedly modal transducers (156) are mounted to the lining (154) using stubs (158) to launch or to excite bending wave vibration to form two loudspeakers which are capable of producing an acoustic output.

Each transducer (156) comprises a single piezoelectric bimorph plate. The plate may be designed to have modes which are suitably interleaved to produce an average force which is substantially constant with frequency in the desired operating frequency range. The lengths of the major axes are chosen to be in the ratio of about $1:\sqrt{9/7}$ (1:1.134). The ratio may be determined in a similar manner to that described below in relation to FIG. 9, in which the ratio of the lengths of the beams in a two-beam transducer is determined.

More than two transducers (156) may be used in advantageous positions so as to achieve a large sound coverage. There is often only a small gap between the roof lining and the roof itself, so the provision of a loudspeaker in the gap is restricted. The modal transducers (156) may be designed to occupy a small space, and are thus highly suited to this application.

Figure 4B:
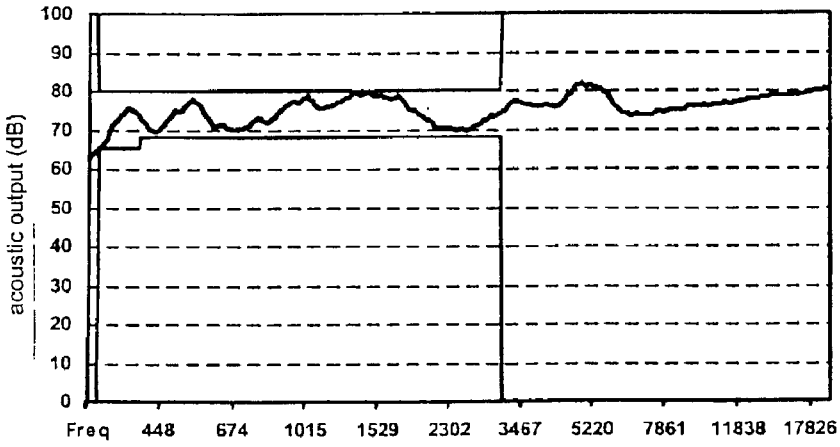
FIG. 4*b* is a graph of acoustic output (dB) against frequency (f) for a section of the automobile roof member of FIG. 4*a;*

FIG. 4*b* shows the frequency response of a loudspeaker which may be used in connection with a mobile phone to allow hands-free operation. As described in FIG. 4*a*, the loudspeaker is formed from a section of the roof liner, in this case a section above the driver's seat. An intendedly modal transducer, comprising two beams of widths of about 7.5 mm, thicknesses of about 300 microns and lengths of about 32 mm and 36 mm, is fixed to an upper surface of the liner. The transducer is driven with 10 volts rms input signal, and the output measured with a microphone at the position of the driver's ear. The graph shows that the loudspeaker produces a reasonably flat response which extends down to approximately 350 Hz.

Figure 5:
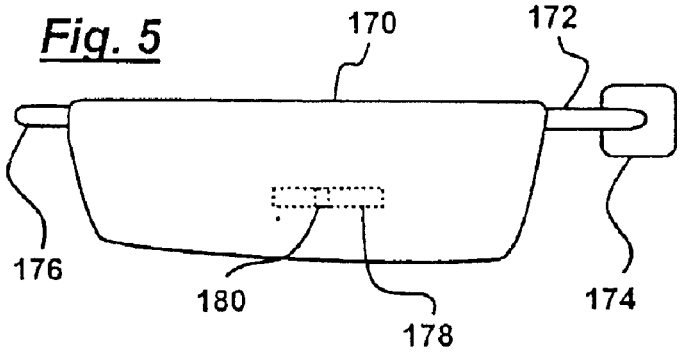
FIGS. 5 and 6 are plan and side views of a sun visor embodying the present invention.
Figure 6:
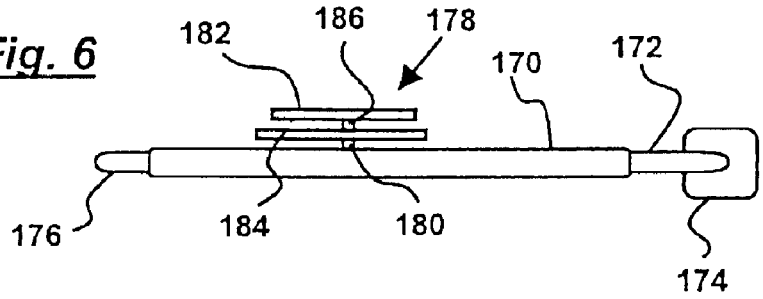

FIGS. 5 and 6 show a sun visor (170) which is supported by a pivot (172) at one end and a bar (176) at the opposed end. The pivot is fixed using a bracket (174) to the roof or side pillar of a vehicle and the bar (176) is designed to be detachably clipped into a retainer fixed into the roof. The sun visor (170) may be designed to be capable of supporting bending waves, particularly resonant bending wave modes. An intendedly modal transducer (178) is mounted to the sun visor (170) using a stub (180) to launch or to excite bending wave vibration to produce an acoustic output.

As shown more clearly in FIG. 6, the transducer (178) comprises upper and lower bimorph beams (182, 184), the lower beam (184) being connected to the panel (170) by the stub (180) and to each other by a connecting stub (186). The stub may extend across the width of the beams, be about 1–2 mm wide and high and may be made from hard plastics and/or metal with suitable insulating layers to prevent electrical short circuits.

The beams are of unequal lengths; the upper beam (182) is longer than the lower beam (184). Each beam consists of three layers, namely two outer layers of piezoelectric ceramic material, e.g. PZT 5H, sandwiching a central brass vane. The outer layers may be attached to the brass vane by adhesive layers which are typically about 10–15 microns in thickness.

Figure 7:
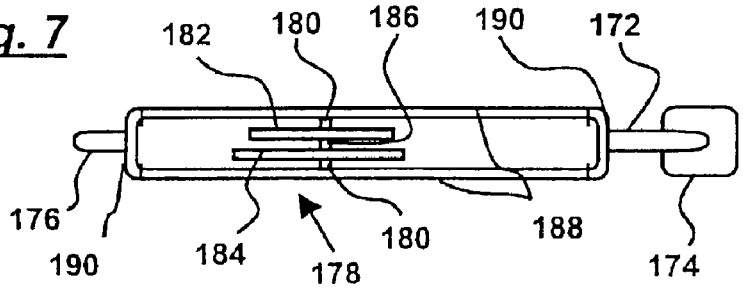
FIG. 7 is a cross-sectional view of an alternative sun visor embodying the present invention.

FIG. 7 shows an alternative sun visor which employs a transducer (178) as depicted in FIG. 6, and thus, elements in common have the same reference number. In FIG. 7, the sun visor comprises two panels (188) which are spaced apart by mounting each panel (188) on a frame or battens (190) which extend around the periphery of each panel (188). Each panel (188) is designed to be capable of supporting bending waves, particularly resonant bending wave modes. The transducer (178) is mounted to both panels (188) using stubs (180) to launch or to excite bending wave vibration in both panels to produce an acoustic output.

Figure 8:
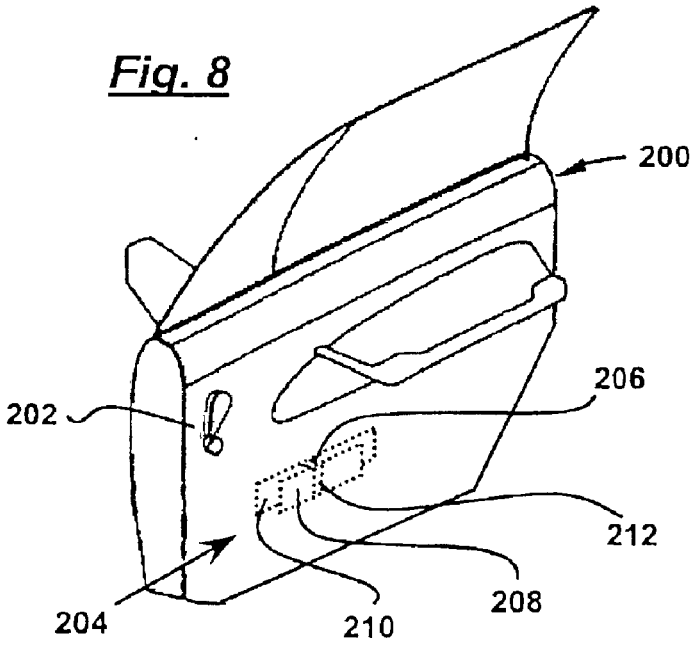
FIG. 8 is a perspective view of an alternate automobile door embodying the present invention.

FIG. 8 shows an automotive door (200), with an interior trim component (202). An intendly modal transducer (204) is fitted on the inside of the trim component (202) in order to convert the trim component into a loudspeaker. In order to transmit the maximum power from the transducer (204) into the trim component (202), the mechanical impedance of the transducer (204) is matched to that of the trim component (202). The transducer (204) is connected to the trim component (202) by way of a stub (206), and in this example the DMA consists of two beams (208,210) connected together by a further stub (212).

In each of the embodiments of FIGS. 1 to 8, as exemplified in FIG. 2, the sound (92) radiates in a wide dispersion pattern which should provide an improved sound field for the occupants of the vehicle, for example by reducing local hot spots. An intendedly modal transducer may be designed with reduced mass and depth compared to a moving coil/permanent magnet design. Accordingly, the use of such a transducer should reduce the overall weight of the loudspeaker carried in the vehicle and the transducer should be suitable for installations in which space is limited, e.g. behind door linings, in head linings or in sun visors. For example, a standard moving coil electromagnetic transducer generally has a weight of approximately 30 g and a height of approximately 13 mm. In contrast, a two-beam modal transducer may have a weight of only approximately 2 g and a height of approximately 5 mm.

The remaining figures show alternative transducers which may be used in conjunction with the loudspeaker applications embodied in FIGS. 1 to 8.

Figure 9:
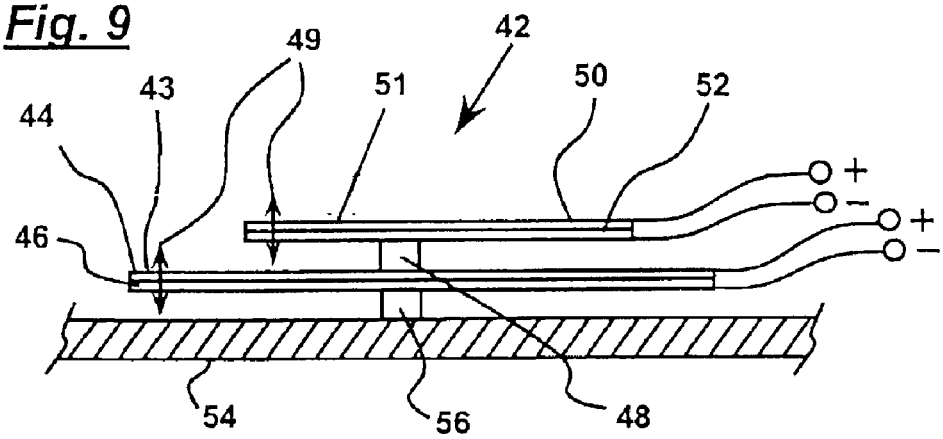
FIGS. 9 to 15 are side views of alternative modal transducers which may be used in the present invention.

FIG. 9 shows a transducer (42) which comprises a first piezoelectric beam (43) on the back of which is mounted a second piezoelectric beam (51) by connecting means in the form of a stub (48) located at the centre of both beams. Each beam is a bi-morph. The first beam (43) comprises two layers (44,46) of piezoelectric material and the second beam (51) comprises two layers (50,52). The poling directions of each layer of piezoelectric material are shown by arrows (49). Each layer (44, 50) has an opposite poling direction to other layers (46, 52), respectively, in the bi-morph. The bimorph may also comprise a central conducting vane which allows a parallel electrical connection as well as adding a strengthening component to the ceramic piezoelectric layers. Each layer of each beam may be made of the same/different piezoelectric material. Each layer is generally of a different length.

The first piezoelectric beam (43) is mounted on a panel (54) by coupling means in the form of a stub (56) located at the centre of the first beam (43). By mounting the first beam (43) at its centre only the even order modes will produce output. By locating the second beam (51) behind the first beam (43), and coupling both beams centrally by way of a stub (48), they can both be considered to be driving the same axially aligned or co-incident position.

When elements are joined together, the resulting distribution of modes is not the sum of the separate sets of frequencies, because each element modifies the modes of the other. The two beams (43, 51) are designed so that their individual modal distributions are interleaved to enhance the overall modality of the transducer (42). The two beams (43, 51) add together to produce a useable output over a frequency range of interest. Local narrow dips occur because of the interaction between the piezoelectric beams (43, 51) at their individual even order modes.

The second beam (51) may be chosen by using the ratio of the fundamental resonance of the two beams (43, 51). If the materials and thicknesses are identical, then the ratio of frequencies is just the square of the ratio of lengths. If the higher f0 (fundamental frequency) is simply placed half way between f0 and f1 of the other, larger beam (43), f3 of the smaller beam (51) and f4 of the lower beam (43) coincide.

Plotting a graph of a cost function against the ratio of the frequency for two beams shows that the ideal ratio is about 1.27:1, namely where the cost function is minimised at point. This ratio is equivalent to the "golden" aspect ratio (ratio of f02:f20) described in WO97/09842 and corresponding U.S. Pat. No. 6,332,029.

The method of improving the modality of a transducer may be extended by using three piezoelectric beams in the transducer. The ideal ratio is about 1.315:1.147:1.

The method of combining active elements, e.g. beams, may be extended to using piezoelectric discs. Using two discs, the ratio of sizes of the two discs depends upon how many modes are taken into consideration. For high order modal density, a ratio of fundamental frequencies of about 1.1+/−0.02 to 1 may give good results. For low order modal density (i.e., the first few or first five modes), a ratio of fundamental frequencies of about 3.2:1 is good. The first gap comes between the second and third modes of the larger disc.

Since there is a large gap between the first and second radial modes in each disc, much better interleaving is achieved with three rather than with two discs. When adding a third disc to the double disc transducer, the obvious first target is to plug the gap between the second and third modes of the larger disc of the previous case. However, geometric progression shows that this is not the only solution. Using fundamental frequencies of f0, $\alpha$.f0 and $\alpha^2$.f0, and plotting rms ($\alpha$, $\alpha^2$) there exist two principal optima for $\alpha$. The values are about 1.72 and about 2.90, with the latter value corresponding to the obvious gap-filling method.

Using fundamental frequencies of f0, $\alpha$.f0 and $\beta$.f0 (so that both scalings are free) and using the above values of a as seed values, slightly better optima are achieved. The parameter pairs ($\alpha$, $\beta$) are (1.63, 3.03) and (3.20, 8.19). These optima are quite shallow, meaning that variations of 10%, or even 20%, in the parameter values are acceptable.

An alternative approach for determining the different discs to be combined is to consider the cost as a function of the ratio of the radii of the three discs. The cost functions may be RSCD (ratio of sum of central differences), SRCD (sum of the ratio of central differences) and SCR (sum of central ratios). For a set of modal frequencies, $f_0$, $f_1$, $f_n$, . . . $f_N$, these functions are defined as:

*RSCD* (*R* sum *CD*):

$$RSCD = \frac{\frac{1}{N-1}\sum_{n=1}^{N-1}(f_{n+1} + f_{n-1} - 2f_n)^2}{f_0}$$

*SCRD* (sum *RCD*):

$$SRCD = \frac{1}{N-1}\sum_{n=1}^{N-1}\left(\frac{f_{n+1} + f_{n-1} - 2f_n}{f_n}\right)^2$$

*SCR*:

$$SCR = \frac{1}{N-1}\sum_{n=1}^{N-1}\left(\frac{f_{n+1} \cdot f_{n-1}}{(f_n)^2}\right)$$

The optimum radii ratio, i.e. where the cost function is minimised, is about 1.3 for all cost functions. Since the square of the radii ratio is equal to the frequency ratio, for these identical material and thickness discs, the results of (1.3) (1.3)=1.69 and the analytical result of 1.67 are in good agreement.

Figure 10:
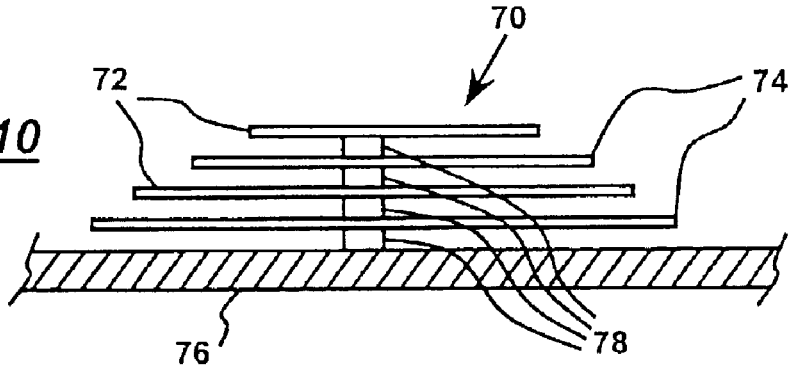

Alternatively or additionally, passive elements may be incorporated into the transducer to improve its overall modality. The active and passive elements may be arranged in a cascade. FIG. 10 shows a multiple disc transducer (70) comprising two active piezoelectric elements (72) stacked with two passive resonant elements (74), e.g. thin metal plates so that the modes of the active and passive elements are interleaved.

The elements are connected by connecting means in the form of stubs (78) located at the centre of each active and passive element. The elements are arranged concentrically. Each element has different dimensions with the smallest and largest discs located at the top and bottom of the stack, respectively. The transducer (70) is mounted on a load device (76), e.g. a panel, by coupling means in the form of a stub (78) located at the centre of the first passive device which is the largest disc.

The method of improving the modality of a transducer may be extended to a transducer comprising two active elements in the form of piezoelectric plates. Two plates of dimensions (1 by $\alpha$) and ($\alpha$ by $\alpha^2$) are coupled at (3/7, 4/9). The frequency ratio is therefore about 1.3:1 (i.e., 1.14×1.14=1.2996).

Figure 11:
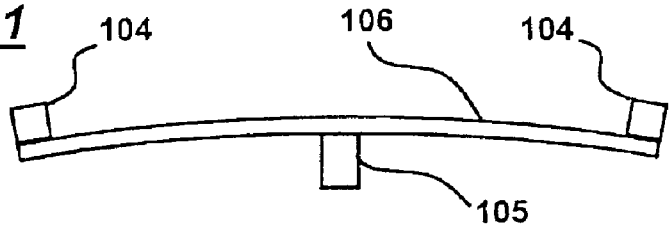
Figure 12:
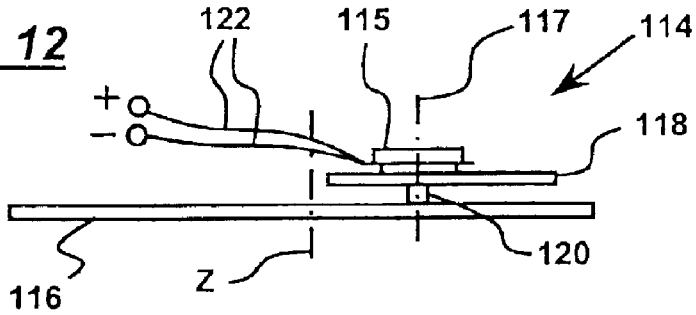

As shown in FIG. 11, small masses (104) may be mounted at the end of the piezoelectric transducer (106) having coupling means (105). In FIG. 12, the transducer (114) is an inertial electrodynamic moving coil exciter, e.g. as described in WO97/09842 and U.S. Pat. No. 6,332,029, having a voice coil forming an active element (115) and a passive resonant element in the form of a modal plate (118). The active element (115) is mounted on the modal plate (118) and off-centre of the modal plate.

The modal plate (118) is mounted on the panel (116) by a coupler (120). The coupler is aligned with the axis (117) of the active element but not with the axis (Z) normal to the plane of the panel (116). Thus the transducer is not coincident with the panel axis (Z). The active element (115) is connected to an electrical signal input via electrical wires (122). The modal plate (118) is perforate to reduce the acoustic radiation therefrom. As previously mentioned, the active element (115) is located off-centre of the modal plate (118), for example, at the optimum mounting position, i.e. (3/7, 4/9).

Figure 13:
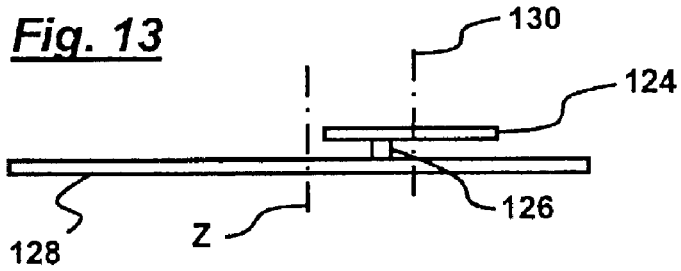

FIG. 13 shows a transducer (124) comprising an active piezoelectric resonant element which is mounted by coupling means (126) in the form of a stub to a panel (128). Both the transducer (124) and panel (128) have ratios of width to length of about 1:1.13. The coupling means (126) is not aligned with any axes (130,Z) of the transducer or the panel. Furthermore, the placement of the coupling means (126) is located at the optimum position, i.e. off-centre with respect to both the transducer (124) and the panel (128).

Figure 14:
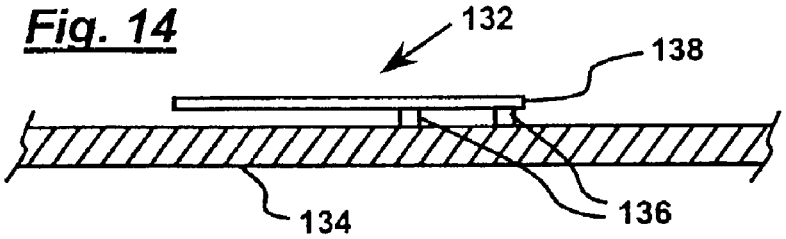

FIG. 14 shows a transducer (132) in the form of active piezoelectric resonant element in the form of a beam. The transducer (132) is coupled to a panel (134) by two coupling means (136) in the form of stubs. One stub is located towards an end (138) of the beam and the other stub is located towards the centre of the beam.

Figure 15:
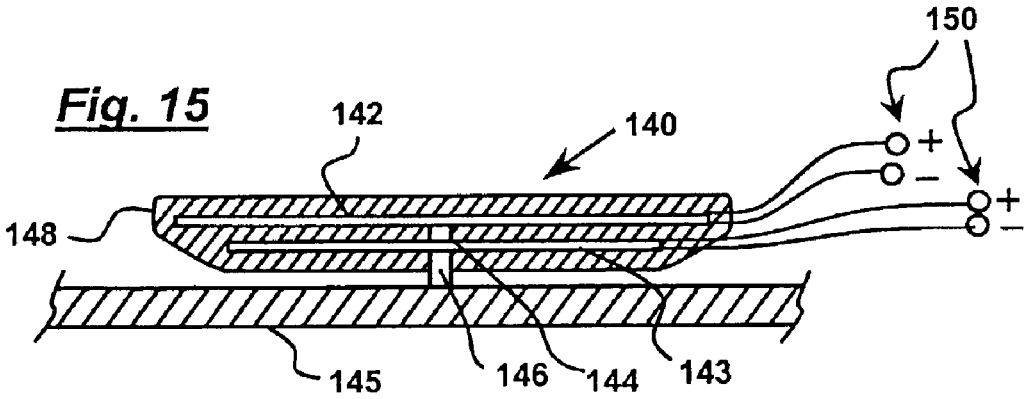

FIG. 15 shows a transducer (140) comprising two active resonant elements (142,143) coupled by connecting means (144) and an enclosure (148) which surrounds the connecting means (144) and the resonant elements (142, 143). The transducer (140) is thus made shock and impact resistant. The enclosure (148) is made of a low mechanical impedance rubber or comparable polymer so as not to impede the transducer operation. If the polymer is water resistant, the transducer (140) may be made waterproof.

The upper resonant element (142) is larger than the lower resonant element (143) which is coupled to a panel (145) via a coupling means (146) in the form of a stub. The stub is located at the centre of the lower resonant element (143). The power couplings (150) for each active element (142, 143) extend from the enclosure (148) to allow good audio attachment to a load device (not shown).

Figure 16:
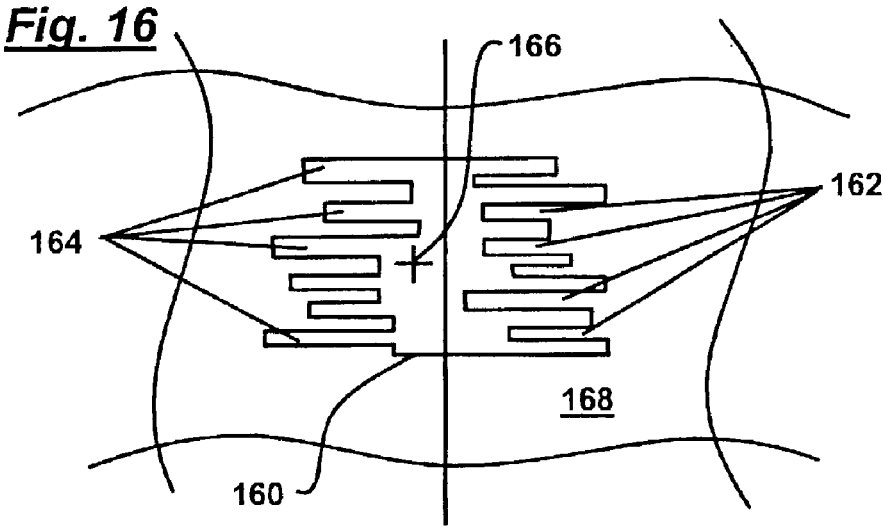
FIG. 16 is a plan view of an alternative modal transducer which may be used in the present invention.

FIG. 16 shows a transducer (160) in the form of a plate-like active resonant element. The resonant element is formed with slots (162) which define fingers (164) and thus form a multi-resonant system. The resonant element is mounted on a panel (168) by a coupling means in the form of a stub (166).

Figure 17A:
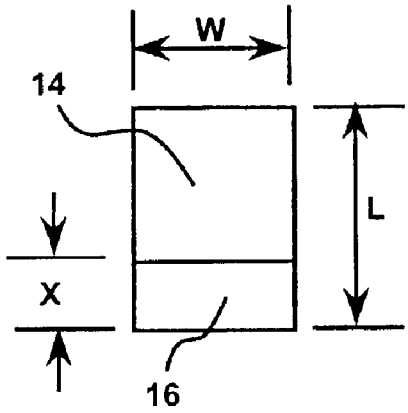
FIG. 17A is a schematic plan view of a parameterised model of a transducer which may be used in the present invention.
Figure 17B:
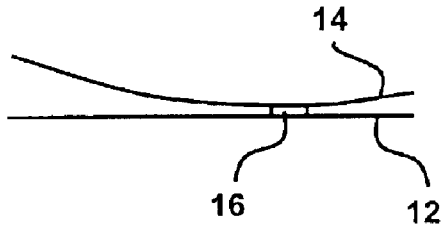
FIG. 17B is a section perpendicular to the line of attachment of the transducer of FIG. 17A.
Figure 18A:
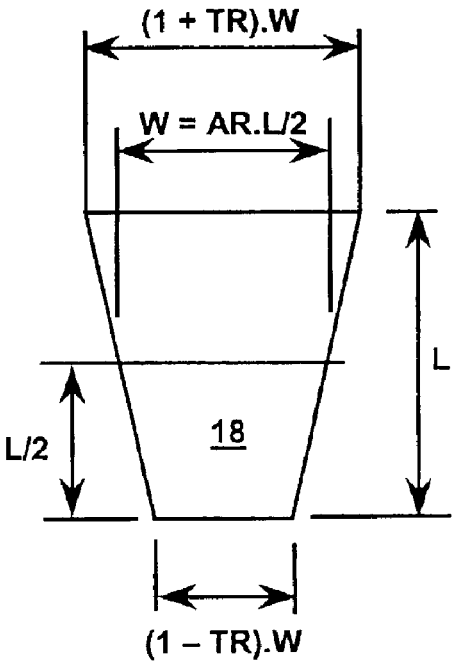
FIG. 18A is a schematic plan view of a parameterised model of a transducer which may be used in the present invention.
Figure 18B:
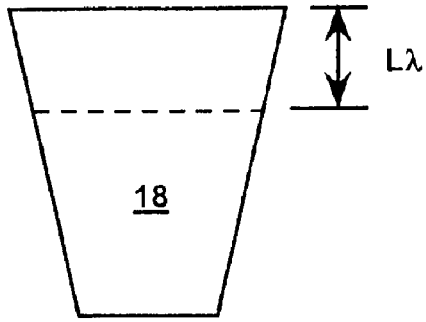
FIG. 18B is a section perpendicular to the line of attachment of the transducer of FIG. 18A.

In FIGS. 17A and 17B, the transducer (14) is rectangular with out-of-plane curvature and is a pre-stressed piezoelectric transducer of the type disclosed in U.S. Pat. No. 5,632,841 (International patent application WO 96/31333) and produced by PAR Technologies Inc. under the trade name NASDRIV. Thus the transducer (14) is an active resonant element. The transducer has a width (W) and a length (L) and a position (x) defining an attachment point (16).

The curvature of the transducer (14) means that the coupling means (16) is in the form of a line of attachment. When the transducer (14) is mounted along a line of attachment along the short axis through the centre, the resonance frequencies of the two arms of the transducer are coincident. The optimum suspension point may be modelled and has the line of attachment at about 43% to about 44% along the length of the resonant element. The cost function (or measure of "badness") is minimised at this value; this corresponds to an estimate for the attachment point at 4/9the of the length (L). Furthermore, computer modelling showed this attachment point to be valid for a range of transducer widths. A second suspension point at about 33% to about 34% along the length (L) of the resonant element also appears suitable.

By plotting a graph of cost (or rms central ratio) against aspect ratio (AR=W/2L) for a resonant element mounted at 44% along its length, the optimum aspect ratio may be determined to be 1.06+/−0.01 to 1 since the cost function is minimised at this value.

The optimum angle of attachment θ to the panel (12) may be determined using two "measures of badness" to find the optimum angle. For example, the standard deviation of the log (dB) magnitude of the response is a measure of "roughness". Such figures of merit/badness are discussed in International Application WO 99/41939 and corresponding U.S. patent application Ser. No. 09/246,967, of the present applicants. For an optimised transducer, namely one with aspect ratio of about 1.06:1 and attachment point at about 44% using modelling, rotation of the line of attachment (16) will have a marked effect since the attachment position is not symmetrical. There is a preference for an angle of about 270°, i.e. with the longer end facing left.

FIGS. 16A and 16B show an asymmetrically shaped transducer (18) in the form of a resonant element having a trapezium shaped cross-section. The shape of a trapezium is controlled by two parameters, AR (aspect ratio) and TR (taper ratio). AR and TR determine a third parameter, λ, such that some constraint is satisfied, for example, equal mass either side of the line.

The constraint equation for equal mass (or equal area) is as follows:

$$\int_0^{\lambda}\left(1+2TR\left(\frac{1}{2}-\xi\right)\right)d\xi=\int_{\lambda}^{1}\left(1+2TR\left(\frac{1}{2}-\xi\right)\right)d\xi$$

The above may readily be solved for either TR or λ as the dependent variable, to give:

$$TR=\frac{1-2\lambda}{2\lambda(1-\lambda)}\text{ or }\lambda=\frac{1+TR-\sqrt{1+TR^2}}{2TR}\approx\frac{1}{2}-\frac{TR}{4}$$

Equivalent expressions are readily obtained for equalising the moments of inertia, or for minimising the total moment of inertia.

The constraint equation for equal moment of inertia (or equal 2nd moment of area) is as follows:

$$\int_0^{\lambda}\left(1+2TR\left(\frac{1}{2}-\xi\right)\right)(\lambda-\xi)^2d\xi=\int_{\lambda}^{1}\left(1+2TR\left(\frac{1}{2}-\xi\right)\right)(\xi-\lambda)^2d\xi$$

$$TR=\frac{(\lambda^2-\lambda+1)(2\lambda-1)}{2\lambda^4-4\lambda^3+2\lambda-1}\text{ or }\lambda\approx\frac{1}{2}-\frac{TR}{8}$$

The constraint equation for minimum total moment of inertia is $$\frac{d}{d\lambda}\left(\int_0^{1}\left(1+2TR\left(\frac{1}{2}-\xi\right)\right)(\lambda-\xi)^2d\xi\right)=0$$

$$TR=3-6\lambda\text{ or }\lambda=\frac{1}{2}-\frac{TR}{6}$$

A cost function (measure of "badness") was plotted for the results of 40 FEA runs with AR ranging from 0.9 to 1.25, and TR ranging from 0.1 to 0.5, with λ constrained for equal mass. The transducer is thus mounted at the centre of mass. The results are tabulated below and show that there is an optimum shape with AR=1 and TR=0.3, giving λ at close to 43%.

| tr | λ | 0.9 | 0.95 | 1 | 1.05 | 1.1 | 1.15 | 1.2 | 1.25 |
|---|---|---|---|---|---|---|---|---|---|
| 0.1 | 47.51% | 2.24% | 2.16% | 2.16% | 2.24% | 2.31% | 2.19% | 2.22% | 2.34% |
| 0.2 | 45.05% | 1.59% | 1.61% | 1.56% | 1.57% | 1.50% | 1.53% | 1.66% | 1.85% |
| 0.3 | 42.66% | 1.47% | 1.30% | 1.18% | 1.21% | 1.23% | 1.29% | 1.43% | 1.59% |
| 0.4 | 40.37% | 1.32% | 1.23% | 1.24% | 1.29% | 1.25% | 1.29% | 1.38% | 1.50% |
| 0.5 | 38.20% | 1.48% | 1.44% | 1.48% | 1.54% | 1.56% | 1.58% | 1.60% | 1.76% |

One advantage of a trapezoidal transducer is thus that the transducer may be mounted along a line of attachment which is at its centre of gravity/mass but is not a line of symmetry. Such a transducer would thus have the advantages of improved modal distribution, without being inertially unbalanced. The two methods of comparison used previously again select about 270° to about 300° as the optimum angle of orientation.

The transducer used in the present invention may be seen as the reciprocal of a distributed mode panel, e.g. as described in WO97/09842 and corresponding U.S. Pat. No. 6,332,029, in that the transducer is designed to be a distributed mode object.

It should be understood that this invention has been described by way of examples only and that a wide variety of modifications can be made without departing from the scope of the invention as described in the accompanying claims.

We claim:

1. A vehicle component for mounting in a passenger compartment of a vehicle, the component comprising:

a loudspeaker having at least one acoustic radiator capable of supporting bending wave vibration; and an electromechanical force transducer mounted to the acoustic radiator to excite bending waves in the acoustic radiator to produce an acoustic output, wherein the transducer has an intended operative frequency range and comprises:

an active resonant element having a frequency distribution of modes in the operative frequency range, wherein parameters of the resonant element are selected to enhance the distribution of modes in the resonant element in the operative frequency range, and wherein the distribution of modes in the resonant element has a density of modes which is sufficient for the resonant element to provide an effective mean average force which is substantially constant with frequency; and a coupler for mounting the transducer to the acoustic radiator.

2. A vehicle component according to claim 1, wherein the modes are distributed substantially evenly over the intended operative frequency range.

3. A vehicle component according to claim 1, wherein the resonant element is modal along two substantially normal axes, each axis having an associated fundamental frequency, and wherein the ratio of the two associated fundamental frequencies is adjusted for best modal distribution.

4. A vehicle component according to claim 3, wherein the ratio of the two fundamental frequencies is about 9:7.

5. A vehicle component according to claim 1, wherein the transducer comprises a plurality of resonant elements each having a distribution of modes, the modes of the resonant elements being arranged to interleave in the operative frequency range whereby the distribution of modes in the transducer is enhanced.

6. A vehicle component according to claim 1, wherein the resonant element is plate-like.

7. A vehicle component according to claim 1, wherein the shape of the resonant element is selected from the group consisting of beam-like, trapezoidal, hyperelliptical, generally disc shaped or rectangular.

8. A vehicle component according to claim 7, wherein the resonant element is plate-like.

9. A vehicle component according to claim 1, further comprising:

grooves adapted to form a generally rectangular acoustically active area.

10. A vehicle component according to claim 9, wherein the generally rectangular acoustically active area is stiffened with a lightweight cellular core to form a panel-form acoustic radiator.

11. A vehicle component according to claim 9, wherein parameters of the resonant element are selected to enhance the distribution of modes in the resonant element in the operative frequency range.

12. A vehicle component according to claim 11, wherein the distribution of modes in the resonant element has a density of modes which is sufficient for the resonant element to provide an effective mean average force which is substantially constant with frequency.

13. A vehicle component according to claim 11, wherein the modes are distributed substantially evenly over the intended operative frequency range.

14. A vehicle component according to claim 1, wherein the component is selected from one of an internal trim, an interior door pillar, an interior vehicle centre console, a parcel shelf, a sun visor, a rear view mirror, a headrest, and a seat back.

15. A vehicle component according to claim 1, wherein the component is a sun visor, wherein the loudspeaker comprises two acoustic radiators, wherein the transducer is sandwiched between the two radiators, and wherein the transducer is mounted to drive both radiators simultaneously.

16. A vehicle component according to claim 15, wherein parameters of the resonant element are selected to enhance the distribution of modes in the resonant element in the operative frequency range.

17. A vehicle component according to claim 16, wherein the distribution of modes in the resonant element has a density of modes which is sufficient for the resonant element to provide an effective mean average force which is substantially constant with frequency.

18. A vehicle component according to claim 16, wherein the modes are distributed substantially evenly over the intended operative frequency range.

19. A vehicle comprising a passenger compartment and a vehicle component mounted in the passenger compartment, the component comprising:

a loudspeaker having an acoustic radiator capable of supporting bending wave vibration; and an electromechanical force transducer mounted to the acoustic radiator to excite bending waves in the acoustic radiator to produce an acoustic output, wherein the transducer has an intended operative frequency range and comprises:

an active resonant element having a frequency distribution of modes in the operative frequency range, wherein parameters of the resonant element are selected to enhance the distribution of modes in the resonant element in the operative frequency range, and wherein the distribution of modes in the resonant element has a density of modes which is sufficient for the resonant element to provide an effective mean average force which is substantially constant with frequency; and a coupler for mounting the transducer to the acoustic radiator.

* * * * *